US006158752A

United States Patent [19]

Kay

[11] Patent Number: 6,158,752

[45] Date of Patent: Dec. 12, 2000

[54] WHEELED VEHICLE WITH CONTROL SYSTEM

[76] Inventor: Albert R. Kay, P.O. Box 362, Burney, Calif. 96013

[21] Appl. No.: 09/150,633

[22] Filed: Sep. 9, 1998

[51] Int. Cl.[7] ..... A63C 17/02

[52] U.S. Cl. ..... 280/87.042; 280/11.28

[58] Field of Search ..... 280/11.19, 11.2, 280/11.26, 11.27, 11.28, 14.2, 87.01, 87.042, 87.05, 87.043, 87.021, 222, 11.115, 220, 265

[56] References Cited

U.S. PATENT DOCUMENTS

| | | | |
|---|---|---|---|
| 1,622,198 | 3/1927 | Keeler | 280/222 |
| 3,152,812 | 10/1964 | Cummings | 280/11.19 |
| 4,098,519 | 7/1978 | Reid, Jr. | 280/87.01 |
| 4,190,261 | 2/1980 | Moutz | 280/87.01 |
| 4,323,258 | 4/1982 | Culpeper | 280/87.01 X |
| 4,411,442 | 10/1983 | Rills | 280/87.042 |
| 4,595,209 | 6/1986 | Tsai | 280/87.042 |
| 4,915,403 | 4/1990 | Wild et al. | 280/87.042 X |
| 4,955,626 | 9/1990 | Smith et al. | 280/87.042 |
| 5,169,166 | 12/1992 | Brooks | 280/87.042 |
| 5,224,719 | 7/1993 | Goodspeed | 280/87.042 |
| 5,372,384 | 12/1994 | Smith | 280/87.042 |
| 5,458,351 | 10/1995 | Yu | 280/87.042 |
| 5,505,474 | 4/1996 | Yeh | 280/87.042 |
| 5,551,717 | 9/1996 | De Courcey Milne | 280/87.042 |
| 5,819,865 | 10/1998 | Cowley | 280/87.042 X |
| 5,839,737 | 11/1998 | Kruczek | 280/87.042 X |
| 5,947,495 | 9/1999 | Null et al. | 280/87.042 |

*Primary Examiner*—Lanna Mai
*Assistant Examiner*—Ruth Ilan
*Attorney, Agent, or Firm*—Theodore J. Bielen, Jr.

[57] ABSTRACT

A vehicle movable on at least first and second wheels utilizing a first platform having wheels attached to the same. A second platform is rotatably attached to the first platform and spaced outwardly from the first and second wheels attached to the first platform. Bosses, fixed to the second platform, extend to the vicinity of the first platform wheels. Linkage, such as rods, are rotatably attached to the bosses and to the wheels for provision of steering and braking controls.

17 Claims, 4 Drawing Sheets

WHEELED VEHICLE WITH CONTROL SYSTEM

BACKGROUND OF THE INVENTION

The present invention relates to a novel and useful wheeled vehicle having a control system.

Vehicles such as skateboards, scooters, and the like have found great popularity over the years with persons possessing a degree of athleticism. For example, youngsters have popularized such types of vehicle to the extent that competitive events exist to measure operational skills.

Unfortunately, vehicles, such as skateboards and scooters, often lack adequate steering and braking controls. This deficiency has resulted in numerous injuries to persons using the same.

A wheeled vehicle having a novel control mechanism for steering and braking would be a notable advance in the recreational field.

SUMMARY OF THE INVENTION

In accordance with the present invention a novel and useful wheeled vehicle having a braking and steering control system is herein provided.

The vehicle of the present invention utilizes a first platform, the undersurface of which is connected to first and second wheels in a swiveling manner. A second platform is rotatably attached to and spaced from the first platform. The second platform includes an upper surface for contact by the user of the vehicle.

A steering system of the present invention is further provided with a boss which is fixed to the second platform and extends to the vicinity of the first and second swiveling wheels connected to the first platform undersurface. The boss may extend through a slot. A first link is rotatably attached to the boss and rotatably attached to the first swiveling wheel. Likewise, a second link is rotatably attached to the second boss and rotatably attached to the second swiveling wheel.

In addition, third and fourth swiveling wheels are connected to the undersurface of the first platform. Another boss is fixed to the second platform and extends to the vicinity of the third and fourth wheels through a slot in the first platform. A third link rotatably attaches to the second boss and to the third swiveling wheel, while a fourth link rotatably attaches to the second boss and to the fourth swiveling wheel.

Each of the wheels may include a tab having a pair of sites for connecting the particular link extending from either the first or second bosses through the first platform.

In one embodiment of the invention, the second platform may be split into two independently rotatable portions relative to the first platform. With respect to such a case, either of the portions of the second platform may be tilted independently of one another. Moreover, any of the first, second, third, or fourth links connected to either of the bosses may be fastened to any one of the fastening sites of the wheel associated tabs. Thus, the forward portion of the board may be used to steer the vehicle while the rear portion may either be used to steer or to brake the vehicle. In this instance, either one or two persons may operate the vehicle.

It may be apparent that a novel and useful vehicle and steering system for the same has been described.

It is therefore an object of the present invention to provide a vehicle in which a steering mechanism may be employed by simply tilting one of a pair of spaced platforms in a particular direction.

Another object of the present invention is to provide a platform type vehicle which includes a braking system that is operable independently of the steering system of the platform vehicle.

A further object of the present invention is to provide a platform type vehicle which may be usable by one or two persons, each of which is capable of steering or braking the vehicle.

Yet another object of the present invention is to provide a platform-type vehicle which possesses versatility in that such vehicle is capable of moving in either of opposite directions, and a steering mechanism which is easily converted into a braking mechanism.

A further object of the present invention is to provide a platform-type vehicle which is relatively simple to manufacture and to maintain.

The invention possesses other objects and advantages especially as concerns particular characteristics and features thereof which will become apparent as the specification continues.

Figure 1:
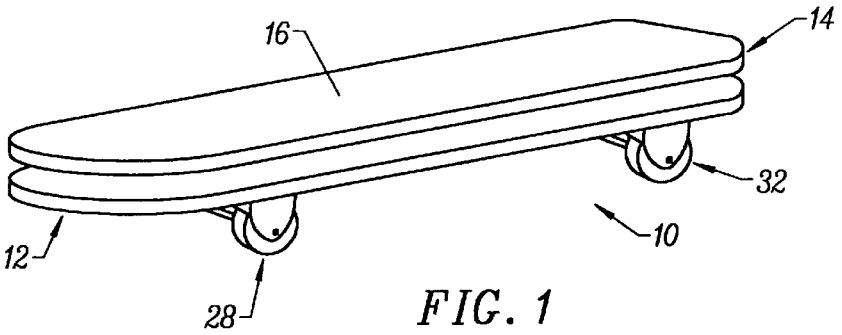
FIG. 1 is a top left perspective view of the vehicle of the present invention.

For a better understanding of the invention reference is made to the following detailed description of the preferred embodiments thereof which should be taken with the prior described drawings.

DETAILED DESCRIPTION OF THE PREFERRED EMBODIMENTS

Various aspects of the present invention will evolve from the following preferred embodiments of the invention which should be viewed with the prior delineated drawings.

The invention is shown in the drawings by reference character 10. The vehicle 10 includes a first platform 12 and a second platform 14 which are spaced from one another, FIG. 1. Second platform 14 includes an upper surface 16 which is intended to support the user or users of vehicle 10.

Figure 2:
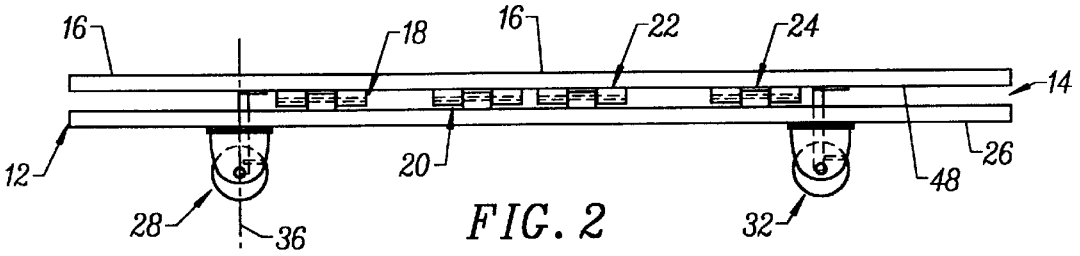
FIG. 2 is a side elevational view of the vehicle of the present invention.

It should be noted that vehicle 10 may move left-to-right or right-to-left as depicted in FIGS. 1 and 2. Turning to FIG. 2, it may be observed that first platform 12 is rotatably attached to second platform 14 through a plurality of pivoting or journaled bearings 18, 20, 22, and 24. Thus, a second platform 14 is capable of tilting or listing relative to first platform 12, which will be detailed hereinafter. A damping mechanism may be placed between platforms 12 and 14 (not shown).

Figure 3:
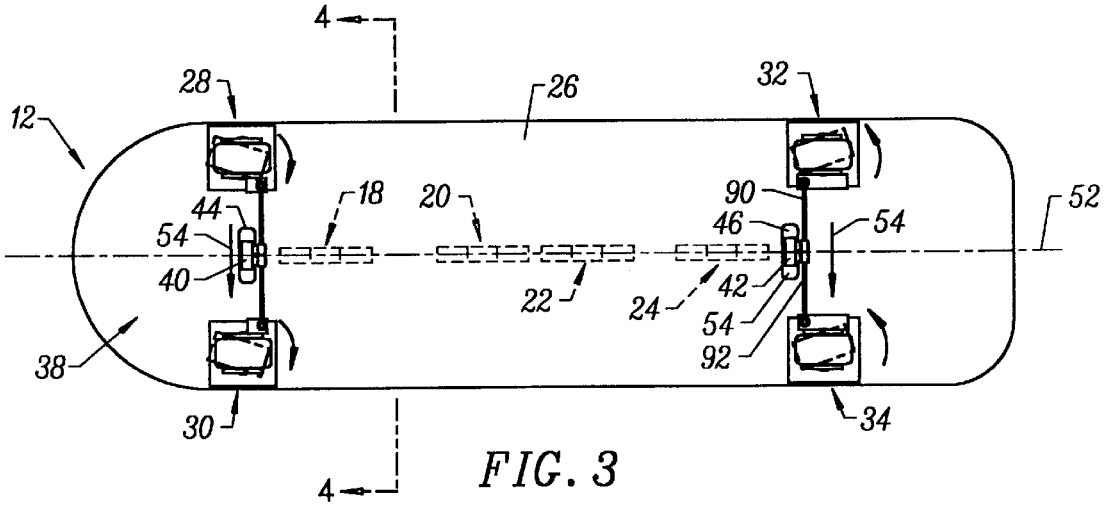
FIG. 3 is a bottom plan view of the vehicle of the present invention.

Turning to FIG. 3, it may be seen that a quartet of wheels are attached to lower surface 26 of first platform 12. First and second wheels 28 and 30 are paired to operate together. Likewise, third and fourth wheels, 32 and 34 are intended to operate in conjunction with one another. Wheels 28, 30, 32, and 34 swivel relative to first platform 12. The axes of such swiveling is generally perpendicular to lower surface 26 of first platform 12. Axis 36 of first wheel 28, FIG. 2, illustrates this relationship.

Figure 4:
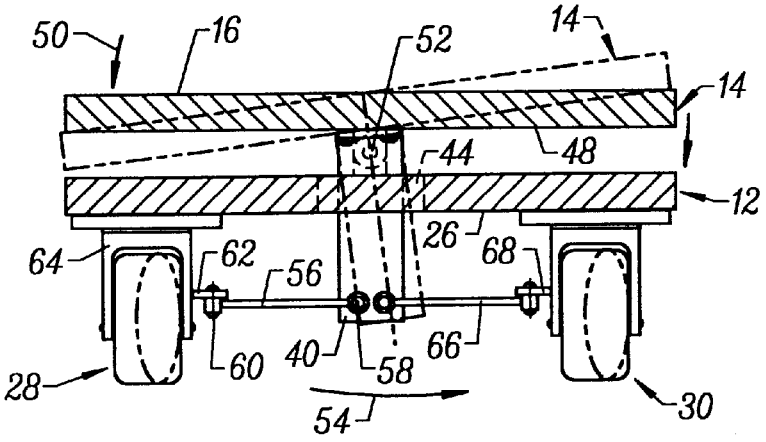
FIG. 4 is a sectional view taken along line 4—4 of FIG. 3.
Figure 5:
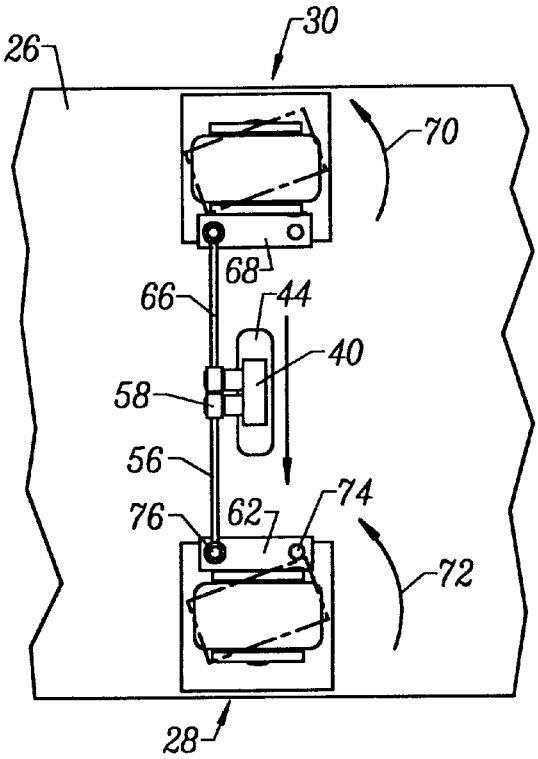
FIG. 5 is a bottom plan view of the first and second wheels depicted in FIG. 3, with linkages reversed.

Vehicle 10 also possesses a novel steering mechanism 38 best shown in FIGS. 3, 4, and 5. Steering mechanism 38 includes the provision of a pair of bosses or tongues 40 and 42 which are rigidly fixed to second platform 14 at undersurface 43 thereof by any suitable fastening means, such as screws, nails, bolts, adhesives, welds, and the like. Tongues 40 and 42 extend through slots 44 and 46 through first platform 12, respectively. As depicted on FIG. 4, tongue or boss 40, depending from undersurface 43 of second platform 14, is extending through slot 44 to the vicinity of wheels 28 and 30. In the embodiments depicted in FIGS. 1–5, boss 42 also extends through slot 46 in the same manner. FIG. 4 illustrates a tilting force placed on the edge of upper surface 16 of second platform 14, directional arrow 50, which causes second platform 14 to rotate about axis 52, causing tongue 40 to move toward wheel 30, directional arrow 54 of FIG. 4.

With further reference to FIG. 4, link 56 rotatably attaches to boss 40 at pivot 58. Link 56 also rotatably attaches to wheel 28 at pivot 60. Tab 62 on wheel skirt 64 of first wheel 28 provides the necessary place for pivot 60. Likewise, link 66 is similarly and rotatably fixed to tongue 40 and tab 68 of wheel 30. Looking at FIG. 5, it may be apparent that links 56 and 66 have been reversed to the opposite side of tongue 40 causing wheels 28 and 30 to move according to directional arrows 70 and 72, opposite to the direction depicted in FIG. 3. With respect to wheel 28 such reversal is achieved by moving link 56 from placement site or opening 74 of tab 62 to opening 76 of tab 62, as well as reversing pivot 58 from one side of boss 40 to the other. The same reversal has taken place with respect to link 66 associated with wheel 30. Turning to FIG. 3, it may be further apparent that wheels 32 and 34 turn oppositely to wheels 28 and 30 when the tilt, shown in FIG. 4, is achieved. Thus, a smooth turn of vehicle takes place.

Figure 6:
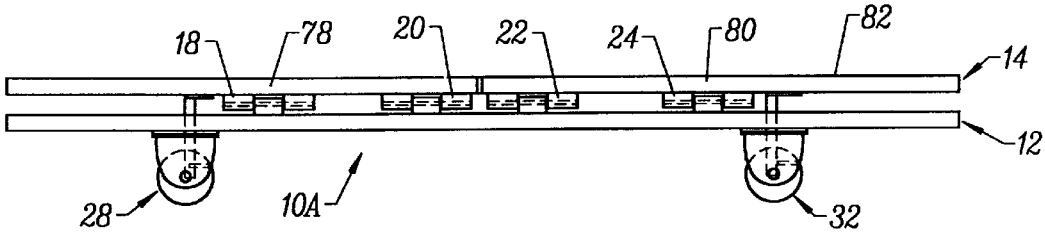
FIG. 6 is a side elevational view of a second embodiment of the present invention.
Figure 7:
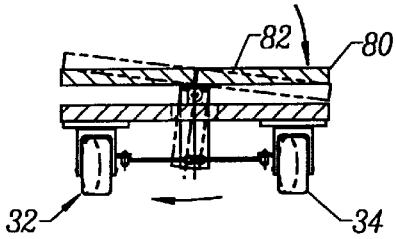
FIG. 7 is an end elevational view of the second embodiment of the present invention.
Figure 8:
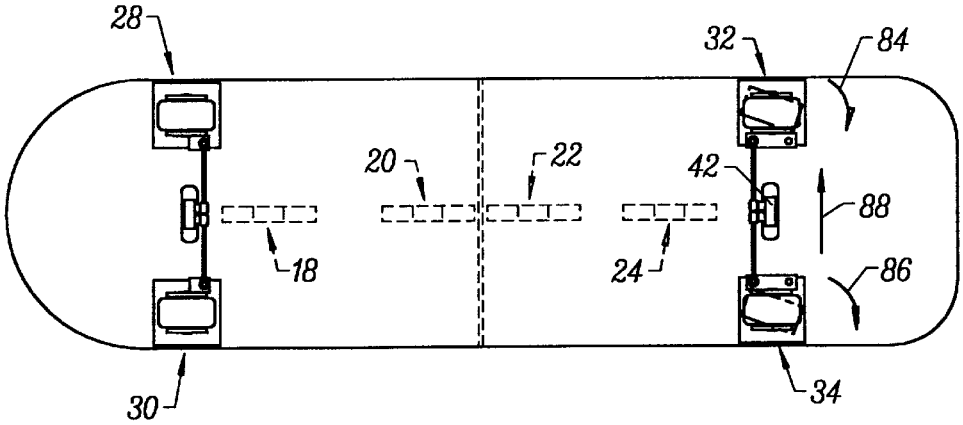
FIG. 8 is a bottom plan view of the second embodiment of the present invention.

Viewing now FIG. 6, another embodiment 10A of the vehicle of the present invention as depicted. In the embodiment shown in FIG. 6, second platform 14 has been split into a first portion 78 and a second portion 80. Thus, journal bearings 18 and 20 serve to connected first portion 78 to first platform 12 in an independently rotatable manner relative to second portion 80 of platform 14. FIGS. 7 and 8 illustrate such movement in which a tilting force has been applied to upper surface 82 of second portion 80 causing wheels 32 and 34 to rotate as shown in FIG. 8 through the movement of boss 42, directional arrows 84, 86, and 88. Wheels 28 and 30 have not been turned by such maneuver.

Figure 9:
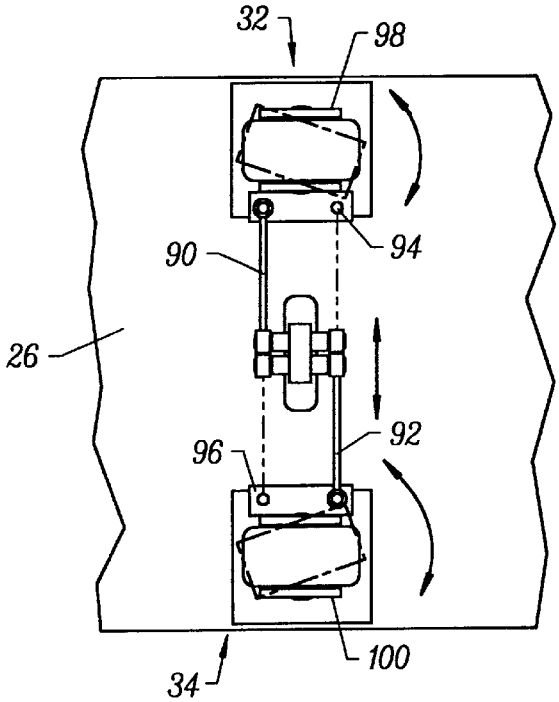
FIG. 9 is a bottom plan view of the third and fourth wheels of a portion of FIG. 8 in which wheels are configured for braking.

Turning to FIG. 9, links 90 and 92 associated with wheels 32 and 34, respectively, have been connected to tabs 94 and 96 on the skirts 98 and 100 of wheels 32 and 34. Any tilt of portion 80 of upper platform 14 will cause vehicle 10A to brake.

Figure 10:
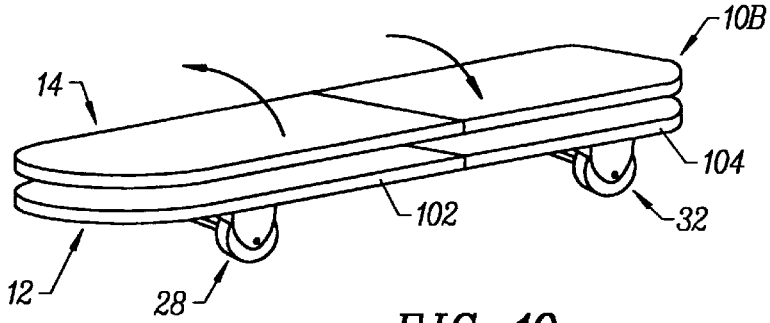
FIG. 10 is a top, left, front perspective view of a third embodiment of the present invention.
Figure 11:
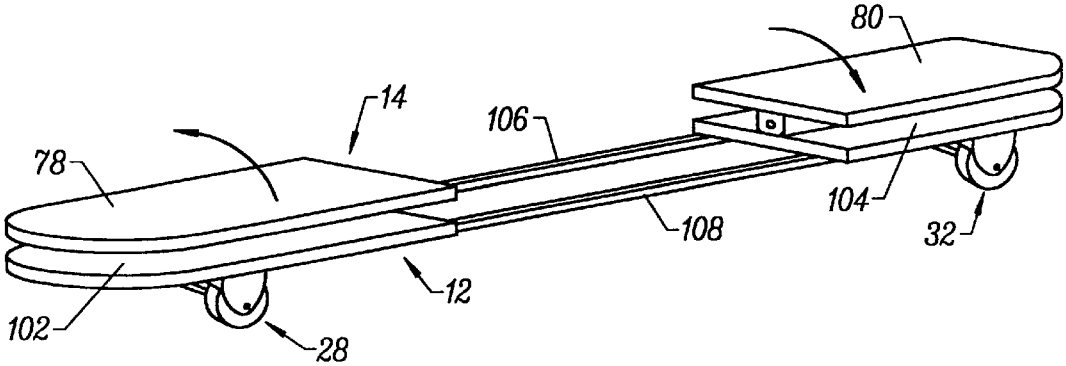
FIG. 11 is a top, left, front perspective view of the third embodiment of the present invention in which the first and second platforms have been separated.

Referring now to FIGS. 10 and 11, a further embodiment of the invention is shown in which first platform 12 is also split into first portion 102 and second portion 104, in the embodiment 10B depicted therewithin. Rails 106 and 108 maintain the rigidity between portions 102 and 104, yet permit the independent rotation of portions 78 and 80 of second platform 14. Thus, if more than one person is using vehicle 10B, each person may be spaced from one another as desired. Leaves or spacers may be placed upon rails 106 and 108, in this regard.

In operation, the user mounts the upper surface 16 of second platform 14 of vehicle 10, FIGS. 1–5 and shifts his weight one way or another to tilt upper platform 14 relative to lower platform 12. Depending on the linkage chosen for wheels, 28, 30, 32, and 34, vehicle 12 will turn in a certain direction. It should be noted that damping or spring means may be used between platforms 12 and 14 to better control such tilting action. Moreover, springs or other shock absorbing structures may be employed with wheels 28, 30, 32 and 34, as is known in the art. With respect to embodiment 10A shown in FIGS. 6–9, a person may place one foot on first portion 78 of second platform 14 and another foot on second portion 80 of second platform 14. Tilting of these portions may take place independently and cause steering of vehicle 10A various ways depending on the linkage used with respect to wheels 28, 30, 32, and 34. In addition, either portion 78 or 80 of upper platform 14 may be rigged, as shown in FIG. 9, to effect braking of vehicle 10A. It should be noted that vehicles 10, 10A, and 10B may be operated in either direction. The vehicle 10B depicted in FIGS. 10 and 11 operates in a manner similar to the vehicle depicted in 10A, with the exception of the separation of the first and second portion 78 and 80 of second platform 14 and first and second portions 102 and 104 of first platform 12, to gain room between operators of vehicle 10B or to increase the wheel base of vehicle 10B.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A vehicle movable on at least first and second swiveling wheels comprising:

a. a first platform, the first and second swiveling wheels being connected to said first platform for turning thereto;

b. a second platform overlying said first platform, said second platform rotatably attached to said first platform, said second platform spaced further outwardly from the first and second swiveling wheels than said first platform; and c. a steering mechanism comprising a boss fixed to said second platform and extending to the vicinity of the first and second swiveling wheels connected to said first platform, said boss moving relative to said first platform with rotation of said second platform; said steering mechanism further comprising a first link rotatably attached to said boss and rotatably attached to said first swiveling wheel, and a second link rotatably attached to said boss and rotatably attached to said second swiveling wheel.

2. The vehicle of claim 1 having third and fourth swiveling wheels connected to said first platform, and in which said boss is a first boss, and which further comprises a second boss fixed to said second platform, said second boss extending to the vicinity of the third and fourth wheels, a third link rotatably attached to said second boss and rotatably attached to said third swiveling wheel, and a fourth link rotatably attached to said second boss and rotatably attached to said fourth swiveling wheel.

3. The vehicle of claim 2 in which said first platform includes first and second slots therethrough, said first and second bosses extending through said first and second slots respectively.

4. The vehicle of claim 1 in which said first and second links comprise elongated rods.

5. The vehicle of claim 2 in which said third and fourth links comprise elongated rods.

6. The vehicle of claim 1 which additionally comprises a tab connected to said first swiveling wheel, said tab including a first fastening site and a second fastening site, said first link being rotatably selectively connected to said tab of said first swiveling wheel at said first and second fastening sites.

7. The vehicle of claim 6 in which said tab is a first tab and additionally comprises a second tab connected to said second swiveling wheel, said second tab including a first fastening site and a second fastening site, said second link being rotatably selectively connected to said tab of said second swiveling wheel at said first and second fastening sites.

8. The vehicle of claim 2 which additionally comprises one tab connected to said third swiveling wheel, said one tab including first and second fastening sites, said third link being selectively rotatably connected to said one tab at said first and second fastening sites.

9. The vehicle of claim 8 which additionally comprises another tab connected to said fourth swiveling wheel, said another tab including first and second fastening sites, said fourth link being selectively rotatably connected to said another tab at said first and second fastening sites.

10. The vehicle of claim 1 in which said second platform includes first and second portions each independently rotatably attached to said first platform.

11. The vehicle of claim 10 which additionally comprises means for adjusting the distance between said first and second portions of said second platform.

12. The vehicle of claim 10 having third and fourth swiveling wheels connected to said first platform, and in which said boss is a first boss, and which further comprises a second boss fixed to said second platform, said second boss extending to the vicinity of the third and fourth wheels, a third link rotatably attached to said second boss and rotatably attached to said third swiveling wheel, and a fourth link rotatably attached to said second boss and rotatably attached to said fourth swiveling wheel.

13. The vehicle of claim 12 in which said first platform includes first and second slots therethrough, said first and second bosses extending through said first and second slots, respectively.

14. The vehicle of claim 10 which additionally comprises a tab connected to said first swiveling wheel, said tab including a first fastening site and a second fastening site, said first link being rotatably selectively connected to said tab of said first swiveling wheel at said first and second fastening sites.

15. The vehicle of claim 14 in which said tab is a first tab and additionally comprises a second tab connected to said second swiveling wheel, said second tab including a first fastening site and a second fastening site, said second link being rotatably selectively connected to said tab of said second swiveling wheel at said first and second fastening sites.

16. The vehicle of claim 12 which additionally comprises one tab connected to said third swiveling wheel, said one tab including first and second fastening sites, said third link being selectively rotatably connected to said one tab at said first and second fastening sites.

17. The vehicle of claim 16 which additionally comprises another tab connected to said fourth swiveling wheel, said another tab including first and second fastening sites, said fourth link being selectively rotatably connected to said another tab at said first and second fastening sites.

* * * * *